United States Patent [19]

Johnson

[11] 4,199,282

[45] Apr. 22, 1980

[54] UNLOADING SYSTEM HAVING VIBRATORY BIN DISCHARGE STRUCTURE

[76] Inventor: Ronald D. Johnson, 3516 W. 97th Pl., Leawood, Kans. 66208

[21] Appl. No.: 897,599

[22] Filed: Apr. 19, 1978

[51] Int. Cl.[2] ..... B65G 53/38

[52] U.S. Cl. ..... 406/136; 366/101

[58] Field of Search ..... 302/52, 53, 56; 222/195; 366/101, 106, 124; 406/136, 137, 134

[56] References Cited

U.S. PATENT DOCUMENTS

| | | | |
|---|---|---|---|
| 3,264,037 | 8/1966 | Smith | 302/52 |
| 4,036,532 | 7/1977 | Waddell et al. | 302/53 |

*Primary Examiner*—Jeffrey V. Nase

*Attorney, Agent, or Firm*—Schmidt, Johnson, Hovey & Williams

[57] ABSTRACT

A pneumatic vibratory bin discharge cone for dry bulk material bins is provided with an annular raised ridge on the inner surface of the frustoconical discharge duct for improved intermittent sealing engagement of the vibrating member with the duct, whereby to create desired vibratory action of the member and to assure positive initiation of material flow from the bin. The raised ridge cooperates with the vibrating member to automatically intensify the amplitude of the latter when resistance to material flow from the bin is encountered such that bin-directed shock waves are created tending to break up flow-resisting conglomerates and bridges in the material. In one embodiment, a novel pneumatic system is disclosed, such system allowing adjustment of air flow to the flexible member whereby the latter may be vibrated without aerating the material. Another embodiment shows a pneumatic system utilizing a rotary pump in parallel with a sealed reciprocating piston assembly whereby the flexible member is provided with the benefits of surge action from the reciprocating piston while at the same time the continuous action rotary pump precludes undesired backwash of bulk material into the pneumatic lines.

2 Claims, 8 Drawing Figures

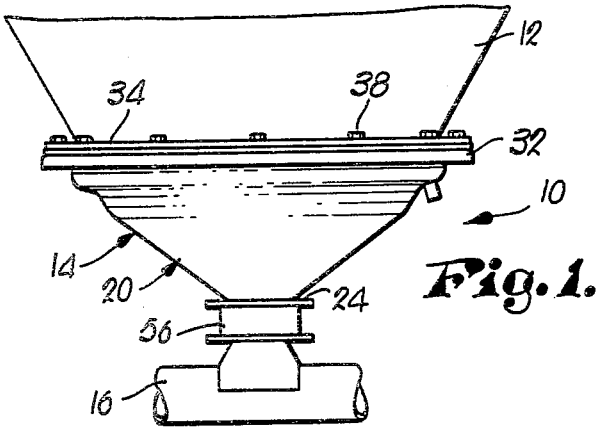
Fig. 1.
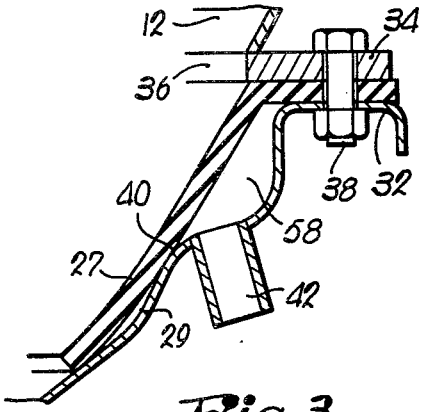
Fig. 3.
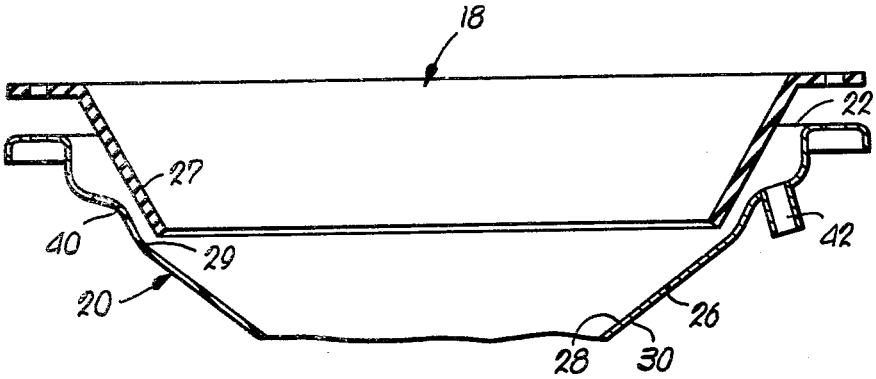
Fig. 2.
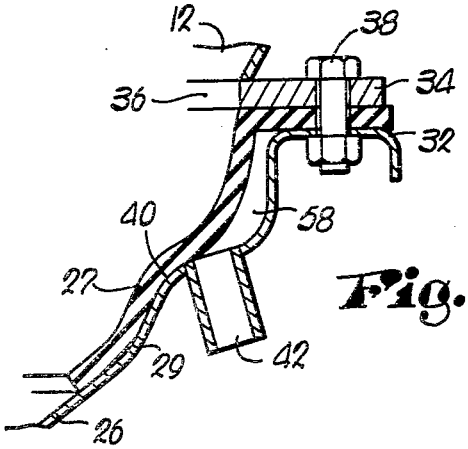
Fig. 4.
Fig. 5.
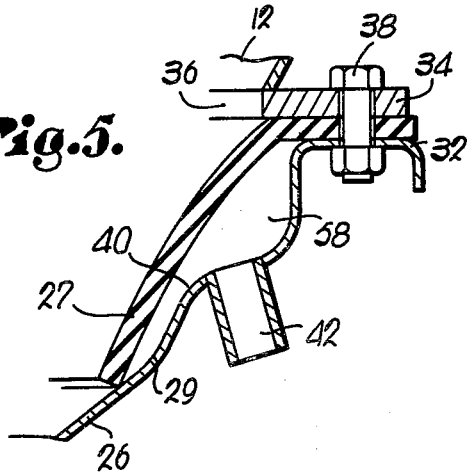
Fig. 6.
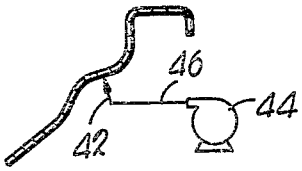
Fig. 7.
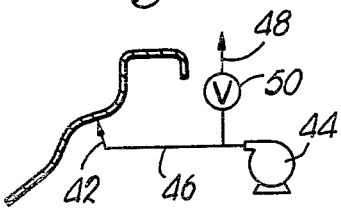
Fig. 8.
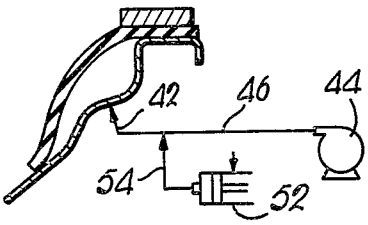

UNLOADING SYSTEM HAVING VIBRATORY BIN DISCHARGE STRUCTURE

This invention relates to bulk material handling systems in general and particularly concerns an improved vibratory bin discharge cone capable of reliably initiating and sustaining material flow from a bin containing dry bulk material even when the material exhibits a tendency to form large flow-resisting conglomerates or bridge across the bin outlet.

Dry bulk material in this context refers to solid material in powdered or granular form. Such material inherently exhibits a tendency to resist flow under the influence of gravity or other forces. This flow-resisting characteristic is particularly acute in large storage bins because material at the bottom of such bins becomes tightly packed under the weight of the remaining material in the bin. Thus, there is often formed a bridge of packed material across the bin outlet such that material flow from the bin through the outlet is precluded. Additionally, the material at the bottom of the bin may be compacted sufficiently to form large cohesive masses which cannot be passed through the bin outlet.

Attempts to overcome the problems described hereinabove typically involve the employment of a material conveyor within the bin itself. Mechanical conveyors such as augers and the like have proved unsatisfactory because of high cost, low reliability, and in some cases, damage to the bulk material. Further in this regard, many dry bulk materials are intended for ultimate human consumption thus requiring that all devices coming in contact with the material meet rigid standards of cleanliness imposed by the various regulating agencies. Most of the mechanical conveyors used to unload bulk material are, by virtue of their construction, extremely difficult to clean properly such that these devices are even less suitable for food handling applications.

One type of discharge device which has shown some promise for use in dry bulk material handling systems is the vibrating bin discharge cone. Discharge devices of this variety typically employ a flexible frustoconical tubular member complementally supported within a rigid funnel-like duct at the bin outlet. Pressurized air is introduced between the duct and the flexible member causing the latter to vibrate in response to intermittant release of the seal between the flexible member and the duct under the influence of the airflow. Escaping air from the space between the member and the duct serves to aerate the bulk material in the discharge cone. This combined vibration and aeration causes the bulk material to behave in many respects like a free-flowing liquid such that discharge from the bin is accomplished in a highly effective manner.

One problem with the above described vibrating cones is an inability under certain operating conditions to initiate the desired material flow, and a further exhibited inability to reliably discharge conglomerate-forming material. This for the reason that the weight of the bulk material in the bin often distorts the flexible member in a manner to prevent formation of an intermittant seal of sufficient strength to cause vibration of the member at a desired amplitude. As a consequence, initiation of material flow from the bin may be precluded. This problem is particularly severe in view of the "bridging" phenomena discussed supra.

One attempt to overcome the aforementioned drawback of vibratory bin discharge cones is shown in U.S.

Pat. No. 3,264,037, issued to Smith and entitled Aeration Cone Assembly. In this patent, the support duct is provided with a second rigid tapered conical tube which supports the flexible member in spaced relation from the duct wall. Hence, undesired deformation of the flexible member under the weight of material in the bin is avoided. However, the construction shown in Smith significantly reduces the vibratory action of the flexible member such that the efficiency of the vibrating cone is decreased. Further, the Smith device is not particularly suited for initiating material flow in instances where the material has become very tightly packed at the bin outlet. An additional problem with the Smith vibratory cone is the tendency of material to collect in the area between the rigid conical tubes thereby making cleaning operations extremely difficult.

Accordingly, it is an important object of the present invention to provide a dry bulk material discharge device of the vibratory cone variety which is capable of initiating and maintaining material flow from a storage bin even in material exhibiting a tendency to form large conglomerates and even under conditions where tightly packed bridges are likely to be encountered at the bin outlet.

In accordance with the foregoing object, it is another important object of the present invention to provide a vibratory cone discharge device wherein the funnel-shaped support duct has a raised ridge for contacting the frustoconical flexible member.

As a corollary to the foregoing object, it is yet another important object of the present invention to provide a vibratory cone discharge device as above wherein the support cone is shaped in such a manner as to present a double seal between the flexible member and the cone thereby assuring vibration of the member at a desired amplitude even under the influence of the dead weight of heavy bulk material stored in the bin.

It is still a further important aim of my invention to provide a bin discharge device as above wherein no additional structure is present in the support duct such that the device is substantially self-cleaning, thereby easily meeting the cleanliness standards required for food handling systems.

An even further object of my invention is to provide a vibratory bin discharge cone wherein the flexible member may be vibrated without causing aeration of the dry bulk material.

In the drawing:

FIG. 1 is a fragmentary, side elevational view of an unloading system having vibratory bin discharge apparatus constructed in accordance with the principles of the present invention;

FIG. 2 is an enlarged, fragmentary, exploded, longitudinal cross-sectional view of the bin discharge apparatus;

FIG. 3 is an enlarged, fragmentary, longitudinal cross-sectional view of the system shown in FIG. 1, taken adjacent the gas inlet port and showing the flexible member in its free state with no load in the bin;

FIG. 4 is a view as in FIG. 3, showing the position of the flexible member when a load of bulk material is stored in the bin;

FIG. 5 is a view as in FIG. 3, showing the flexible member in a deflected position assumed when pressurized air is initially introduced through the gas port;

FIG. 6 is a schematic view showing one embodiment of the pump means for the vibratory bin discharge apparatus;

FIG. 7 is a schematic view showing a second embodiment of the pump means for the vibratory bin discharge apparatus; and FIG. 8 is a schematic view showing a third embodiment of the pump means for the vibratory bin discharge apparatus.

In FIG. 1 there is illustrated a dry bulk material handling system 10 including a material storage bin 12, a vibratory discharge apparatus 14 mounted beneath the bin 12, and a positive pressure pneumatic conveying line 16 disposed to receive discharged material from the apparatus 14. Though shown used in conjunction with a conventional pneumatic conveying line 16, it is to be understood that the discharge apparatus 14 is compatable with all types of auxiliary dry bulk material handling equipment. Further, it is contemplated that the bin 12 used in connection with the apparatus 14 may be of either the mobile or stationary variety.

As shown in FIG. 2, the apparatus 14 comprises a tubular, frustoconical flexible member 18 complementally received within a similarly configured open-ended duct 20. The duct 20 has an upper inlet 22 adjacent the bin 12, an opposed outlet 24 spaced beneath the inlet 22, and a peripheral wall 26 extending between the inlet 22 and outlet 24.

The wall 26 presents an inner surface 28 and an opposed outer surface 30, the flexible member 18 having a peripheral segment 27 being normally biased against a portion 29 of the inner surface 28 to form a releasable seal therebetween.

An annular flange 32 circumscribing the inlet 22 on duct 20 is secured to a corresponding flange 34 around the outlet 36 of bin 12 by a plurality of bolts 38. As shown for example in FIG. 3, the uppermost edge of the flexible member 18 is sandwiched between the flanges 32, 34 thereby serving as a gasket such that the duct 20 is secured in sealed communication with the interior of the bin 12.

Considering now the exploded view in FIG. 2, it can be seen that biasing of peripheral segment 27 of the flexible member 18 against the portion 29 of the inner surface 28 is due at least in part to the fact that the wall of member 18 is substantially steeper than the corresponding wall 26 of duct 20. Hence, when the duct 20 is mounted on the bin 12 as shown in FIG. 3, the peripheral segment 27 of member 18 is deflected somewhat from its free state such that it securely engages the portion 29 of the inner surface 28. Further in this regard, note that when the bin 12 contains a load of bulk material, the flexible member 18 will be conformal with an even larger portion of the inner surface 28 as shown for example in FIG. 4. This of course is due to the fact that the weight of the material contained in the bin 12 pushes against the flexible member 18 to further deform the latter to the configuration shown.

There is formed in the inner surface 28 of the wall 26 a circuital raised ridge 40 which is normally engaged by the flexible member 18. A gas port 42 opens through the wall 26 at a location intermediate the inlet 22 and the portion of the inner surface 28 which normally is in contact with the flexible member 18. Note that as shown in FIGS. 3 and 4, the ridge 40 deforms the flexible member 18 in a manner to assure a strong seal between the portion 29 and the segment 27 when a full load is carried in the bin as represented in FIG. 4. Of course, upon introduction of an airflow through the port 42, the relatively strong seal between portion 29 and segment 27 will be intermittantly broken, thereby producing desired high amplitude vibration of the member 18.

By virtue of the construction of the member 18 and duct 20, there is formed therebetween an annular pocket 58 in communication with the gas port 42. The pocket 58 is expansible under the influence of pressurized gas as will be described further hereinbelow.

As best seen in FIGS. 4 and 5, the portion 29 of the interior surface 28 of the wall 26 has an undulated section between the port 42 and the lower end of the member 18, presenting the raised ridge structure 40.

As shown in FIG. 1, a conventional rotary valve 56 is disposed between the outlet 24 of duct 20 and the conveying line 16 to permit selective sealing of the outlet 24. Of course, it is to be understood that the line 16 is coupled with a conventional blower (not shown) in a manner well known in the pneumatic conveyor art.

The port 42 is adapted to be coupled with a conventional source of pressurized gas such as the pump means shown schematically in FIGS. 6–8. In the preferred embodiment shown in FIG. 6, a rotary air pump 44 is coupled with the port 42 by a conduit 46 such that when pump 44 is actuated, pressurized air is introduced into the pocket 58 via conduit 46 and gas port 42.

In the embodiment shown in FIG. 7, the conduit 46 is provided with a branch line 48 vented to atmosphere, there being an adjustable flow control valve 50 for limiting flow through the line 48.

Finally, in the embodiment shown in FIG. 8, the rotary pump 44 is coupled in parallel with a reciprocating piston assembly 52 through a conduit 54 which interconnects the assembly 52 and the conduit 46. The assembly 52 is essentially a conventional reciprocating pump without the usual check valves; consequently, the assembly 52 introduces a reversing surge action to the pocket 58 through conduits 46, 54.

In use, the material handling system 10 operates to quickly and effectively convey dry bulk material from the bin 12 to a desired storage, use, or transport location. To initiate material flow, valve 56 is first opened to provide flow communication between the outlet 24 of duct 20 and the conveying line 16.

With the bin 12 initially containing an amount of dry bulk material, the apparatus 14 will be disposed substantially in the manner shown in FIG. 4. Upon actuation of the rotary pump 44, pressurized air introduced into the pocket 58 through port 42 pushes against the flexible member 18, deflecting the latter against the weight of the bulk material in the bin 12 and expanding the pocket 58 until the member 18 assumes a position similar to that illustrated in FIG. 5. This initial deflection of the member 18 occurs extremely rapidly and sends shock waves upwardly into the bin 12 through the outlet 36. These initial shock waves are normally sufficient to break up any large masses of material forming a bridge across the outlet 36 such that the dry bulk material soon begins to flow from the bin 12 through the duct 20 into the conveying line 16. When the air pressure in pocket 58 becomes sufficiently great to break the seal between the segment 27 of the flexible member 18 and the portion 29 of surface 28, air temporarily flows from the pocket 58 into the duct 20. Almost instantaneously, the air pressure in pocket 58 is reduced sufficiently to permit reformation of the seal between the member 18 and the surface 28. Rapid intermittant release and reformation of this seal effects desired vibration of the member 18.

Once material flow is initiated through the outlet 36 and duct 20 to line 16, movement of the member 18 changes from strong surges to constant steady vibration as described. Intermittant flow of air from the pocket 58 mixes with the bulk material in duct 20 thereby greatly improving the flow characteristics of the material.

The combined vibration and aeration of the dry material renders the latter similar in behavior to a free-flow liquid. The presence of the ridge 40 augments the vibratory action of the member 18, thereby overcoming virtually all tendency of the material to form flow-blocking bridges.

While it is believed that the preferred embodiment shown in FIGS. 1 through 6 is operable to satisfactorily handle most dry bulk materials under normal operating conditions, in certain instances even greater initial surges may be required to begin the material flow from the bin 12. In such cases, the embodiment of the pump means shown in FIG. 8 serves to provide extremely powerful startup surges to the flexible member 18. In this connection, it is noted that the reciprocating piston assembly 52 presents large pressure surges corresponding to each stroke of its internal piston. These surges are in turn transmitted to the flexible member 18 causing high amplitude shock waves to be directed into the material bin 12 for the purpose of breaking up bridges and conglomerates contained therein. In order to prevent the possible backflow of bulk material into the conduit 54, the rotary pump 44 is provided such that a continuous positive airflow is directed into the pocket 58.

If it should be desired to handle bulk material which is detrimentally affected by aeration, the embodiment of the pump means illustrated in FIG. 7 may be used to vibrate the flexible member 18 without introducing air into the duct 20. In this connection, valve 50 is adjusted such that the pressure in pocket 58 is sufficient to deflect the member 18 to a position approximating that shown in FIG. 5 but not sufficient to push the lowermost edge of the member 18 away from surface 28. Vibration of the member 18 is effected by pressure variation during normal operation of the rotary pump 44. Of course, initial surging of the flexible member 18 to initiate material flow from the tank 12 can be accomplished by simply closing the valve 50 so that all of the gas flow from the pump 44 is directed into the pocket 58 through the conduit 46.

Though FIG. 1 shows a pressurized tank system, it is to be understood that the invention also has particular application in gravity flow systems from storage bins and silos.

From the foregoing, it is apparent that the present invention offers an effective solution to problems heretofore encountered in the operation of vibratory discharge cones. The provision of the raised ridge 40 augments the intermittant sealing engagement of the flexible member 18 with the surface 28 without presenting bulky, hard-to-clean structure within the duct 20. Additionally, the ridge 40 serves to support the flexible member 18 against undesired distention outwardly into the pocket 58 in a manner to cause upward curling of the lower edge of the member 18. In effect, a double seal, one on each side of the ridge 40, is established to assure desired vibratory action of the member 18. The discharge apparatus 14 is substantially self-cleaning by virtue of the relatively smooth contour presented by the inner surface 28.

What I claim is:

1. Pneumatic apparatus for discharging dry bulk material from a storage bin, said apparatus including:

a duct adapted to be mounted beneath said bin in sealed communication with the interior of the latter for receiving bulk material therefrom under the influence of gravity, said duct being provided with a frusto-conical, peripheral wall having an interior and an exterior surface, said duct having an inlet adjacent said bin and an outlet spaced therebelow;

a material-receiving, tubular, flexible, frusto-conical member secured to the bin within said duct and having a peripheral segment normally engaging a portion of the interior surface of said wall, said member having a lowermost open end within the duct, a gas port in said wall intermediate said inlet and said portion and adapted to be coupled with a selectively operable source of pressurized gas for vibrating said member and for aerating said material, to thereby initiate and sustain material flow from the bin through the duct; and raised structure formed in said portion of said interior surface for supporting the member in a manner to favorably dispose said segment for sealing with said portion, and for enhancing the vibratory action of the member, said portion of the interior surface of the wall having an undulated section between said port and said open end of the member presenting said structure, the member being deformable to the configuration of said interior surface by the weight of the material within the duct.

2. In a bulk material storage bin, discharge apparatus including:

an open-ended duct mounted on said bin in sealed communication with the interior of the latter for receiving bulk material therefrom under the influence of gravity, said duct presenting an inlet and an outlet and having a peripheral wall defining an interior and an exterior surface;

a tubular flexible member received within said duct, a peripheral segment of said member being normally biased against a portion of the interior surface of said wall to form a seal therewith;

a gas port in said wall intermediate said portion and said inlet;

selectively actuatable pump means for providing pressurized gas to said port whereby to vibrate said member;

a circuital raised ridge formed in said portion of the interior surface of said wall for supporting the flexible member in a manner to favorably dispose said segment for sealing with said portion, and for said duct whereby to enhance the vibratory action of the member, said pump means including a rotary pump and a conduit extending between said pump and said port, said conduit having a vented branch, there being an adjustable valve in said branch for controlling flow therethrough whereby to permit vibration of said member without releasing said seal.

* * * * *